United States Patent [19]

Hickey

[11] Patent Number: 4,568,220

[45] Date of Patent: Feb. 4, 1986

[54] CAPPING AND/OR CONTROLLING UNDERSEA OIL OR GAS WELL BLOWOUT

[76] Inventor: John J. Hickey, 27 Bowdoin St., Apt. 4-A, Boston, Mass. 02114

[21] Appl. No.: 587,245

[22] Filed: Mar. 7, 1984

[51] Int. Cl.[4] ..... E02B 15/00

[52] U.S. Cl. ..... 405/60; 166/338; 166/364; 405/195; 405/188

[58] Field of Search ..... 405/195, 223, 222, 60, 405/168-171, 188-193; 166/338-344, 359, 360, 362, 363, 364; 169/69

[56] References Cited

U.S. PATENT DOCUMENTS

| | | | |
|---|---|---|---|
| 612,485 | 10/1898 | Conover | 405/170 |
| 1,830,061 | 11/1931 | Howe . | |
| 1,857,788 | 5/1932 | Murphy | 169/69 X |
| 3,012,406 | 12/1961 | Lassen-Nielsen | 405/136 |
| 3,236,301 | 2/1966 | Johnstone et al. | 166/338 |
| 3,250,336 | 5/1966 | Haeber et al. | 175/7 |
| 3,251,611 | 5/1966 | Haeber et al. | 166/338 X |
| 3,500,648 | 3/1970 | Daniell | 405/192 |
| 3,554,290 | 1/1971 | Verolin | 169/2 |
| 3,621,911 | 11/1971 | Baker et al. | 166/5 |
| 3,740,017 | 6/1973 | Pogonowski | 251/5 |
| 4,041,719 | 8/1977 | Baugh | 405/169 |
| 4,266,889 | 5/1981 | Reid et al. | 405/223 |
| 4,283,159 | 8/1981 | Johnson et al. | 405/60 |
| 4,323,118 | 4/1982 | Bergmann | 166/96 |
| 4,417,624 | 11/1983 | Gockel | 166/343 X |

FOREIGN PATENT DOCUMENTS 2002839A 7/1977 United Kingdom .

OTHER PUBLICATIONS

Book Titled "Offshore Drilling Technology" pp. 306-309.

*Primary Examiner*—Dennis L. Taylor

*Attorney, Agent, or Firm*—Morse, Altman & Dacey

[57] ABSTRACT

A system and a method for controlling and/or capping undersea oil or gas well blowouts are disclosed. The system includes a mound and a road bed prepared about and leading to an undersea well head, a base plate having an anchoring track and secured onto the mound and about the well head, a collar member secured to the base plate above the well head by being connected to the anchoring track thereof, a structure also erected on the base plate adjacent the well head, a capping member secured to the structure, a bag floating on the sea surface above the well head and a flexible hose connected between the collar member and the bag. Preferably, at least portions of the mound and the road bed are formed on shore of a plurality of preformed segments, then transported to and assembled in situ on the sea floor about the well head. Preferably, a remotely controlled device is provided designed to do work about the well head and accomodated on the road bed leading to the well head.

14 Claims, 8 Drawing Figures

CAPPING AND/OR CONTROLLING UNDERSEA OIL OR GAS WELL BLOWOUT

BACKGROUND OF THE INVENTION

1. Field of the Invention

The present invention relates generally to undersea oil and gas wells and, more particularly, to a method and a system for capping and/or controlling undersea oil or gas well blowouts.

2. The Prior Art

Man's search for fossil fuel has not yet abated. Prominent in this search is undersea exploration for oil and gas. As known, this is not only expensive but entails much risk. One risk involves blowouts. Blowouts pose grave threat to personnel working near oil and gas wells, They are also dangerous and expensive to cap. Further, runaway wells also are a source of pollution. Consequently, a great deal of effort has been expended, particularly of late, in improving capping and/or controlling undersea oil or gas well blowouts.

An early attempt included the use of a protective hood which could be lowered over the well. See U.S. Pat. No. 1,830,061. A more sophisticated and of course expensive device is represented by the eletrohydraulic blowout prevention developed in the early 60's by the Shell Oil Company. See U.S. Pat. No. 3,250,336. Around the turn of the 70's, an improved hood has been developed for controlling fire and loss of oil in offshore, multiple-well installations. See U.S. Pat. No. 3,554,290. About the same time, Texaco Inc., has developed a clamping device, both submergible and remotely operable, to choke off a blown well casing and flow line. See U.S. Pat. No. 3,740,017. For shallow waters of up to a depth of about 120 feet, a protective shroud has been developed, primarily as a pollution control device, preventing thereby oil spells into the water. See U.S. Pat. No. 4,283,159. A further improvement in hoodlike structures is evident form the British Patent GB No. 2,002,839A and from the U.S. Pat. No. 4,323,118. Also, elaborate subsea stations already have been developed for use about oil or gas wellheads, including remotely controlled wire line robot units, see U.S. Pat. No. 3,621,911. For the in situ hardening of structures on the seafloor by the placing of freshly mixed concrete thereat, see U.S. Pat. No. 4,266,889.

Thus, the known prior art is replete with various attempts at assuring the safe and effective retrieval of undersea oil and gas deposits. Each of these prior art devices, however, has inherent advantages and disadvantages. For, none completely eliminates risk, and most of them are tedious and expensive.

SUMMARY OF THE INVENTION

It is a principal object of the present invention to overcome the above disadvantages by providing an improved method and system for capping and/or controlling undersea oil or gas well blowouts.

More specifically, it is an object of the present invention to provide an improved system for capping and/or controlling undersea oil or gas well blowouts comprising a mound and a road bed, prepared about and leading to an undersea well head, a base plate provided with an anchoring track and secured onto the mound and about the well head, a collar member secured to the base plate above the well head by being connected to the anchoring track of the plate, a structure also erected on the base plate adjacent the well head, a capping member secured to the structure, a bag floating on the sea surface above the well head, and a flexible hose connecting the collar member to the bag. Preferably, the mound and the road bed are formed, on shore, of a plurality of preformed segments, transported to the site and assembled in situ on the sea floor about the well head. Preferably, a remotely controlled device is provided designed to do work about the well head and accomodated on and supported by the road bed leading to the well head.

Other objects of the present invention will in part be obvious and will in part appear hereinafter.

The invention accordingly comprises the method and system of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
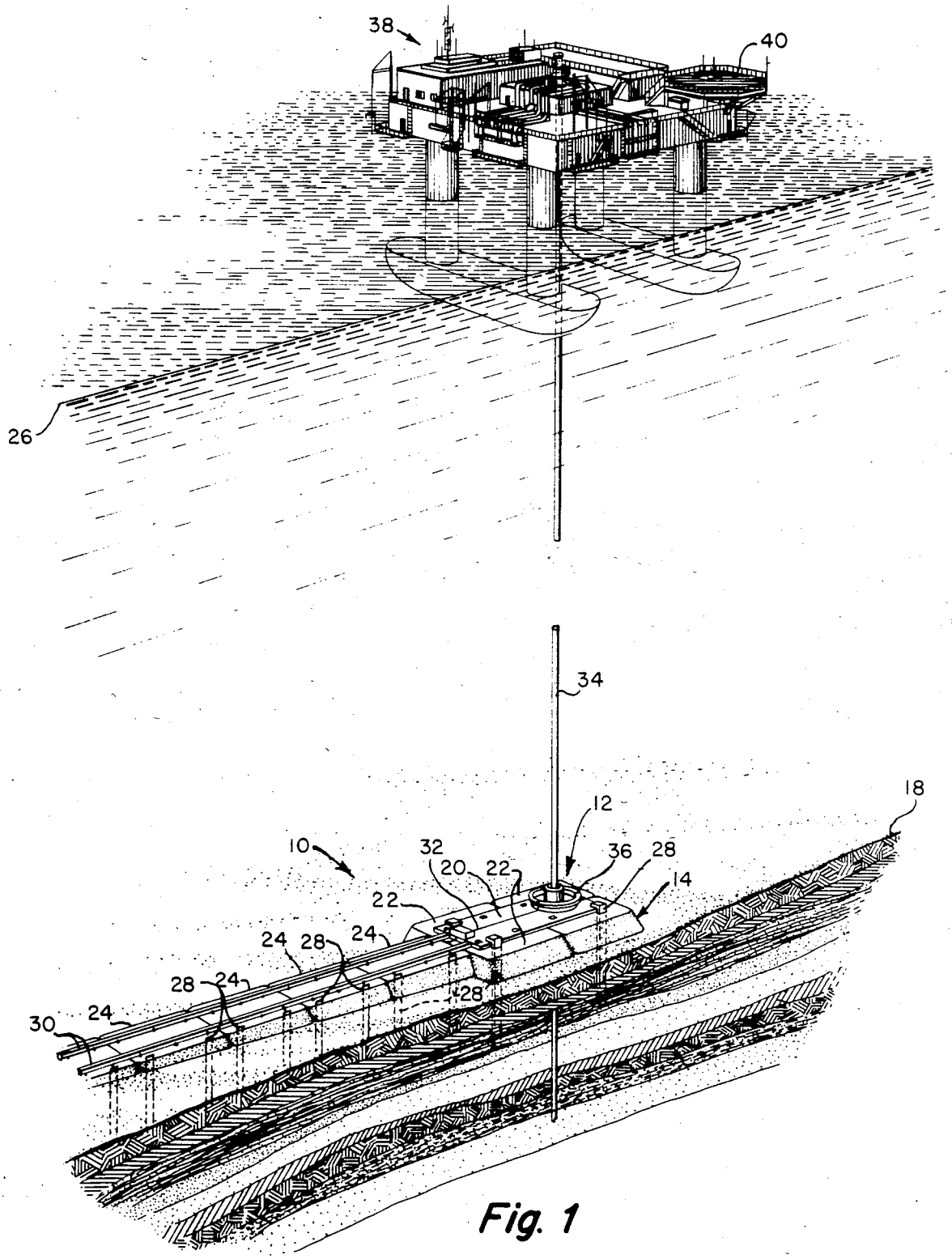
FIG. 1 is a perspective view of a representative arrangement for controlling an undersea oil or gas well blowout and constructed in accordance with the present invention.

In general, the illustrated embodiment of a system 10 for controlling an undersea oil or gas well head 12 against a blowout comprises a mound 14 prepared about the well head 12, a road bed 16 prepared on the sea bottom 18 and leading to the mound 14 and a base plate 20 secured onto the mound 14.

Preferably, both the mound 14 and the road bed 16 are formed on shore of a plurality of preformed segments 22 and 24, respectively. These preformed segments 22 and 24 then are transported to the site on suitable vessels, such as barges, and assembled in situ on the sea bottom 18 and about the well head 12. The weight of these segments 22 and 24 is such that, once put in place on the sea bottom, they are inclined to stay in place, even when exposed to rough and heavy seas. For, the effect of such rough and heavy seas is more pronounced at or near the sea surface 26 as opposed to the sea bottom 18. If desired, these segments 22 and 24 further can be secured to the sea bottom 18 by a plurability of spikes 28. The spikes 28 preferably are driven into the sea bottom 18 to any practicable distance, depending on the composition of the sea bottom 18, so as to achieve a solid anchoring. Preferably, the road bed 16 also is provided with suitable tracks 30, such as railroad tracks. Preferably, the base plate 20 is split into two halves along its longitudinal axis 32 so as to facilitate its positioning about the well head 12, specifically about the flow pipe 34. Further, the base plate 20 is provided with an anchoring track 36, which is circular in construction and formed integral with the base plate 20.

With the above-enumerated items secured in place about the well head 12 on the sea bottom 18, the well head 12 can be placed into production by connecting to the flow pipe 34 an appropriate production platform 38, which can be provided with a helicopter pad 40. Should the well head 12 thereafter suffer a blowout, the above-described system 10 already in place will facilitate its capping as follows.

Figure 2:
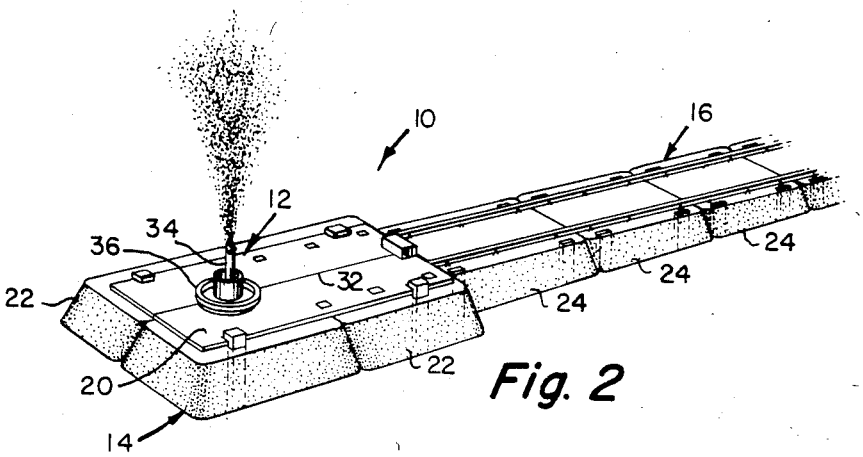
FIG. 2 depicts a portion of the arrangement shown in FIG. 1 after the oil or gas well suffered a blowout.

FIG. 2, which depicts a portion of what is shown in FIG. 1, illustrates the well head 12 after the occurrence of a blowout. It is to be understood that if the above-enumerated items of the system 10 for controlling the blowout are not yet in place about the blown well head 12, then the first order of business is to proceed with its placement, as above described. It will be appreciated that, with the well head 12 blown, work on placing the above-enumerated parts of the system 10 well be more difficult, time-consuming and hazardous than working about a producing well head. For one thing, the blowout will have created debris and also perhaps some erosion around the well head. This debris first will have to be cleared away from the site, Further, any erosion damage about the well head 12 is to be repaired, as for instance, by the introduction of rocks and/or cement so as to fill any crater that may have been formed about the blown well head 12. One known way for placing freshly mixed concrete on the sea bottom 18 and about the blown well head 12 is disclosed in the U.S. Pat. No. 4,266,889, granted to Robert D. Rail et al on May 12, 1981, mentioned above. The ground about the blown well head 12 has to be leveled prior to the placement of the plurality of preformed segments 22 and 24 forming the mound 14 and the road bed 16, respectively. In the alternative, either or both the mound 14 and the road bed 16 can be formed of rocks and cement. This latter alternative is, however, more laborious than using the pre-formed segments 22 and 24, hence less desirable. It is to be used only in instances when the preformed segments 22 and 24 are unavailable and the procurement in time for some reason is not feasible.

With the enumerated parts of the system 10 for controlling a blowout in place about the blown well head 12, and with the debris caused by the blowout cleared away from above the base plate 20 and the road bed 16, the work for capping the blown well 12 can begin.

It will be recalled that the base plate 20 is provided with an anchoring track 36, which is circular in construction and preferably is formed integral with the plate 20. Its construction may best be observed in FIG. 5. In addition to the circular anchoring track 36, the plate 20 also features a sleeve 42 designed to surround the flow pipe 34, as shown. It will also be recalled that the base plate 20 is split along its longitudinal axis 32, which axis 32 also splits the circular anchoring track 36. This facilitates the placement of the plate 20, together with its integral sleeve 42 and anchoring track 36, about the flow pipe 34. Once in place, spikes 28 also are used to anchor the base plate 20 firmly to the sea bottom 18, observe FIGS. 1 and 5.

Figure 3:
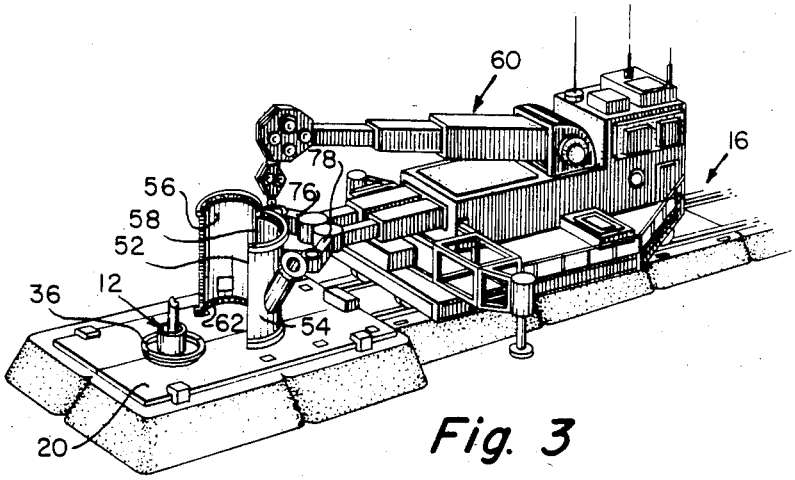
FIGS. 3 and 4 are views simular to FIG. 2 but showing the capping system in various stages of assembly.
Figure 5:
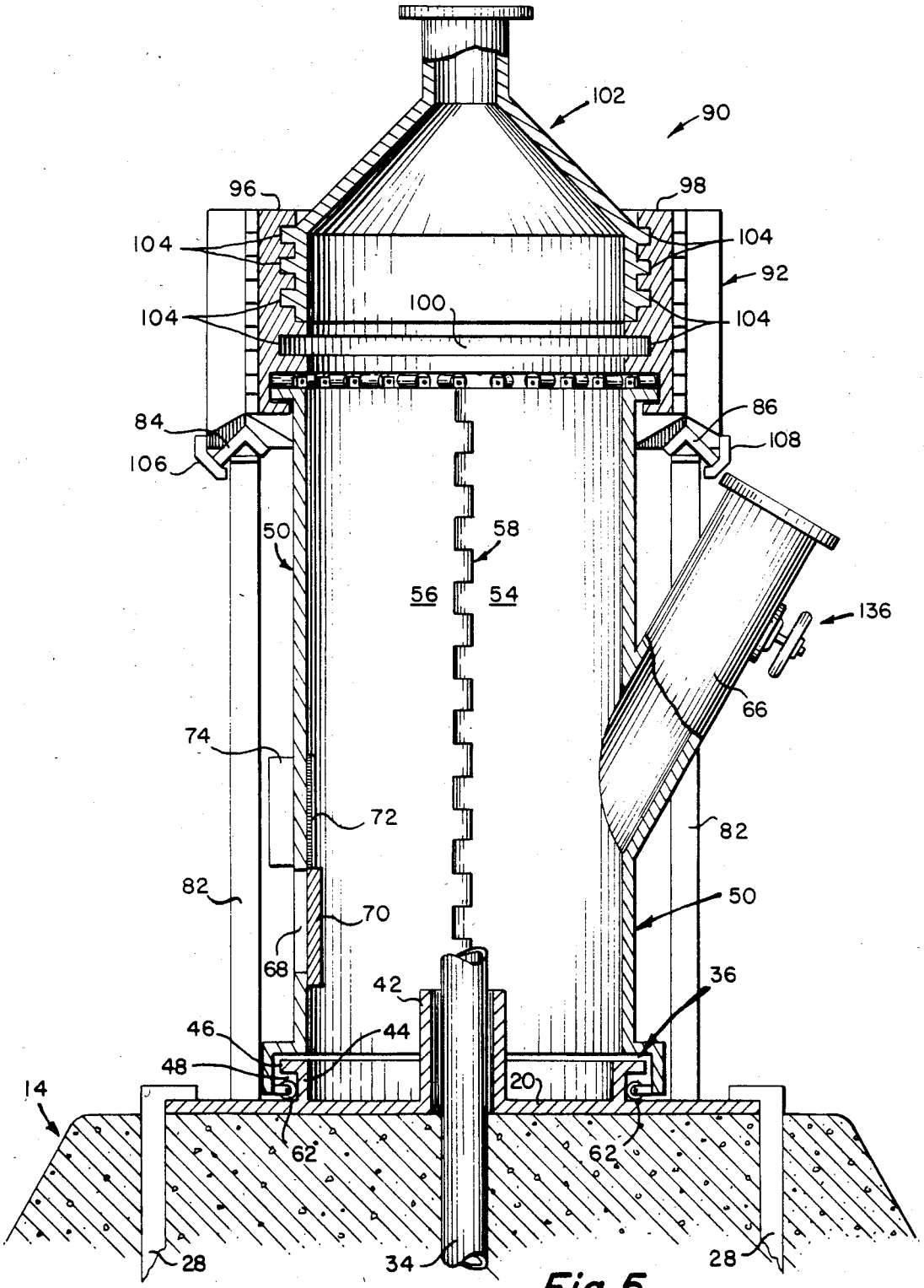
FIG. 5 is a vertical elevation, partly in section, of a portion of the capping system shown in FIG. 4 but on an enlarged scale.
Figure 6:
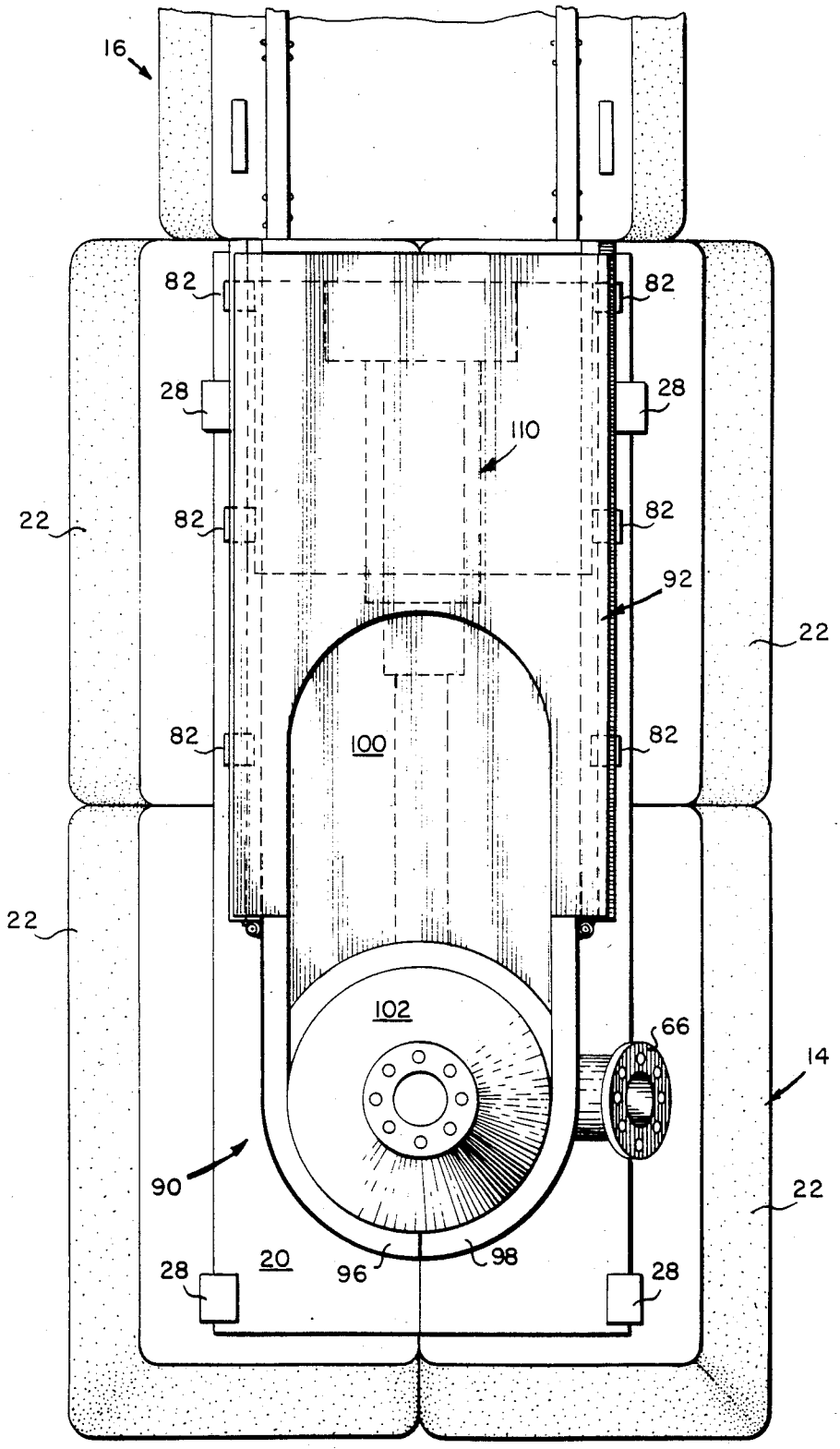
FIG. 6 is a plan view of the system shown in FIG. 5.
Figure 7:
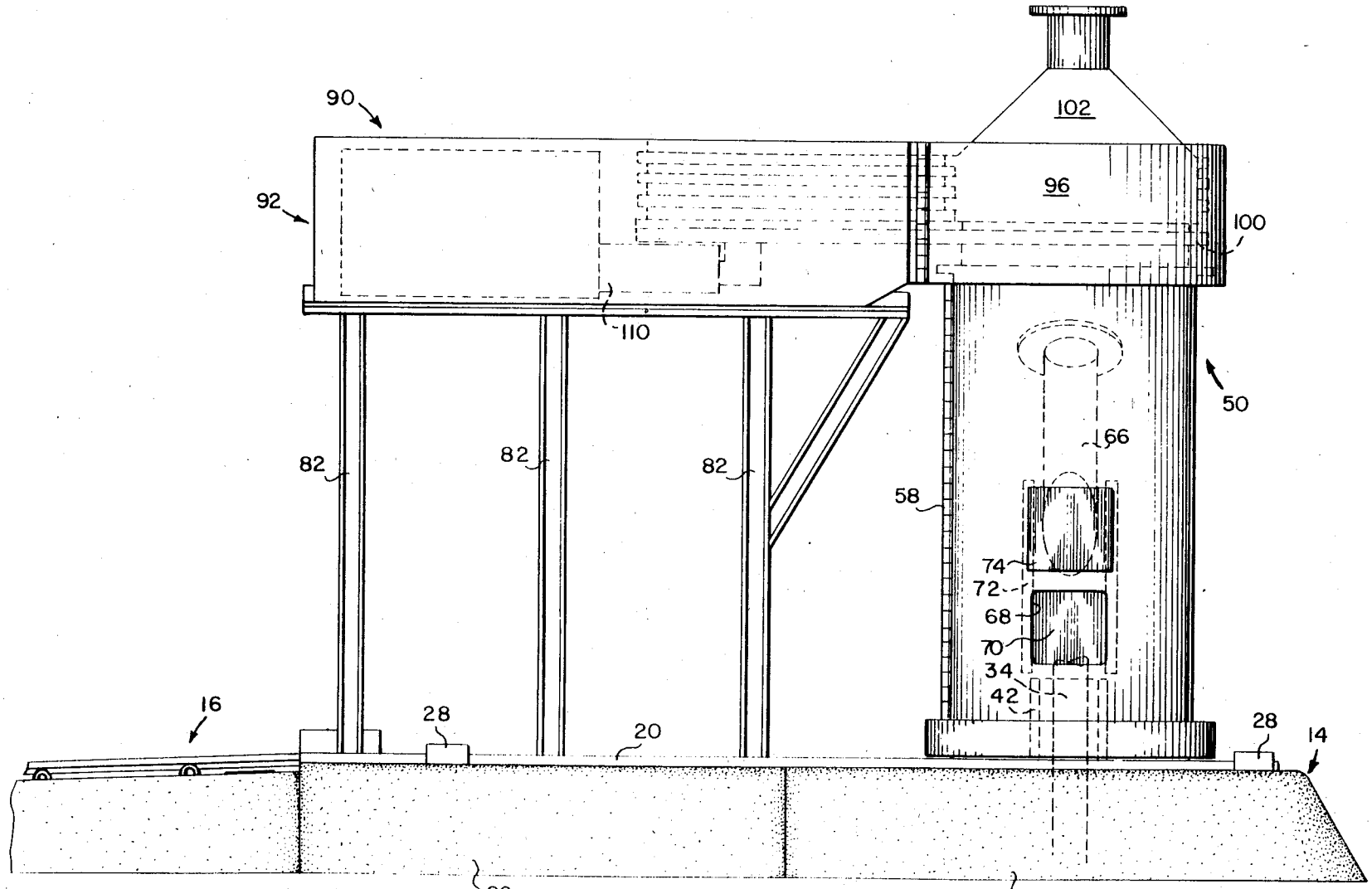
FIG. 7 is a side elevation of the system shown in FIG. 6.

As may be best observed in FIG. 5, the circular anchoring track 36 is of an inverted L-shape in right cross section, formed with an upstanding sleeve portion 44 and a horizontal portion 46. The horizontal portion 46 is parallel spaced from the base plate 20 and forms a circular channel 48 therewith. It is this circular channel 48 which serves as the anchor of the anchoring track 36 for a collar member 50 to be placed and secured thereabout, observe FIG. 3. Again to facilitate the securing of the collar member 50 about the anchoring track 36, the collar member 50 is split along its longitudinal axis 52 into two halves 54 and 56, hingelike fastened to each other at one end, as at 58.

It is to be understood that the collar member 50 first is lowered to the sea bottom 18. Once there, the collar member 50 preferably is grabbed by an extensible arm of a device 60 designed for and adapted to do work at the sea bottom 18 about the well head 12, and accomodated on the road bed 16. Preferably, the device 60 is remotely controlled. Other means of controlling the operation of the device 60 may be as disclosed in the U.S. Pat. No. 3,621,911 granted to Charles Ovid Baker on Nov. 23, 1971. Still other means of controlling the device 60 will readily suggest themselves to those skilled in the art. Further, the shape, structure and operation of the illustrated device 60 is intended to be but representative and illustrative of such a device. Functionally, the device must be operable at deep sea pressures prevailing at the sea bottom 18, must be able to move back and forth on the road bed 16, and must be able to carry, move, actuate, and if need be, provide power to other devices.

Figure 4:
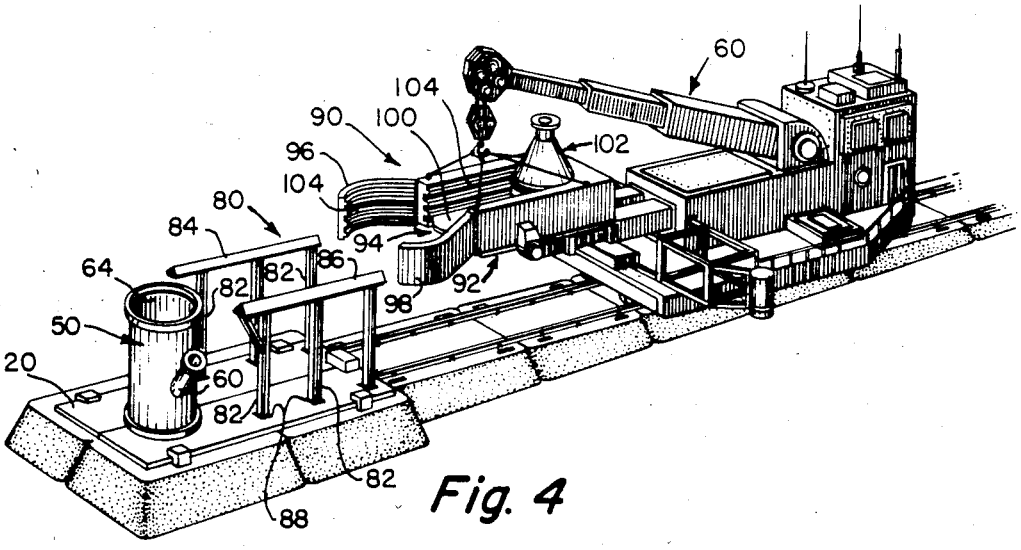

The collar member 50 essentially is a cylinder designed to surround and encase the blown oil or gas well head 12. As may be best observed in FIG. 5, at its bottom, the collar member 50 is provided with and is designed to ride on a plurality of rollers 62. The two halves 54 and 56 of the collar member 50 form a vertical channel 64 (FIG. 4) surrounding the broken well head 12. Additionally, one half 54 of the collar member 50 is provided with a pipe 66 forming an oblique channel.

The other half 56 of the collar member 50 preferably also is provided with an outlet 68 formed diametrically opposite to the convergence of the pipe 66 with the half 54 and somewhat below that convergence, observe FIG. 5. A sliding door 70, designed to slide up and down on a suitable track 72, is provided on the inside of the collar member 50 so as to close-off the outlet 68 at the appropriate time. Suitable means 74, operatively connected to the door 70, is provided to raise and lower the door 70 on the track 72 so as respectively to open or to close the outlet 68.

Initially, the device 60 is caused to place the collar member 50, in its shown open position (observe FIG. 3), onto the base plate 20, with the plurality of rollers 62 riding on the plate 20. Then, the device 60 gradually pushes the still open collar member 50 toward the anchoring track 36 so as to envelope the same, until the rollers 62 tangentially strike against the upright sleeve portion 44 of the anchoring track 36 after entering the circular channel 48 thereof. Whereupon, with the aid of a pair of jaws 76, 78, the device 60 causes the two halves 54 and 56 of the collar member 50 also to be joined at the other end so as to form the vertical channel 64 about the broken gas or oil well head 12, observe FIG. 4. Appropriate closure means, not shown, such as preferably snap-fitting closure means, are used securely to lock the two halves 54 and 56 of the collar member 50 to each other along its longitudinal axis 52. At this point, not only is the top of the vertical channel 64 open, but so is the oblique channel as represented by the pipe 66 and also the outlet 68 in the half 56.

With the collar member 50 securely in place about the broken well head 12, the next step in capping it may now commence. This next step involves the erection in place on the base plate 20 of a structure 80 adjacent the collar member 50, observe FIG. 4. The structure 80 comprises two complementary halves, with each half including a plurality of uprights 82, and a pair of tracks 84 and 86 secured on top of the uprights 82. Preferably, each complementary half of the structure 80 is preassembled on shore, transported to the site and lowered to the sea bottom 18, when with the aid of the device 60, it is put in place. Preferably, a plurality of openings 88 are provided in the base plate 20 to receive the lower, free ends of the uprights 82. Preferably, these openings 88 further are provided with latch means, not shown, so as to secure the uprights 82 therein. With the structure 80 in place adjacent the collar member 50, a capping member 90 next is lowered from the surface 26 and secured to the extensible arm of the device 60.

The capping member 90 essentially compises a U-shaped housing 92 open at one end, as at 94, a pair of jaws 96 and 98 hingeably secured to the housing 92 at the open end 94, a lid 100 and a frusto-conical valve 102. It will be observed that both the housing 92 and the pair of jaws 96 and 98 are provided internally with a plurality of spaced parallel channels 104. It also will be observed that both the lid 100 and the valve 102 are designed for horizontal slidable motion in one or more of these channels 104, as may be best observed in FIG. 5. Further, it will be noted that the housing 92 also is provided at its respective sides with a pair of channel members 106 and 108 by means of which the housing 92 is secured atop the structure 80. Specifically, once the housing 92 is slid over and onto the pair of tracks 84 and 86 by the device 60, the channel members 106 and 108 at least partly surround the tracks 84 and 86, observe FIG. 5. By so doing, the housing 92 of the capping member 90 is snugly held in place on top of the structure 80, while the pair of jaws 96 and 98, once closed, surround and secure the upper free end of the collar member 50. The capping member 90 further is provided with suitable means 110 for sliding the lid 100 and the valve 102 within their respective channels 104. Preferably, the means 110 is a hydraulic means, which is remotely operable, including from a vessel on the surface 26 of the sea.

Figure 8:
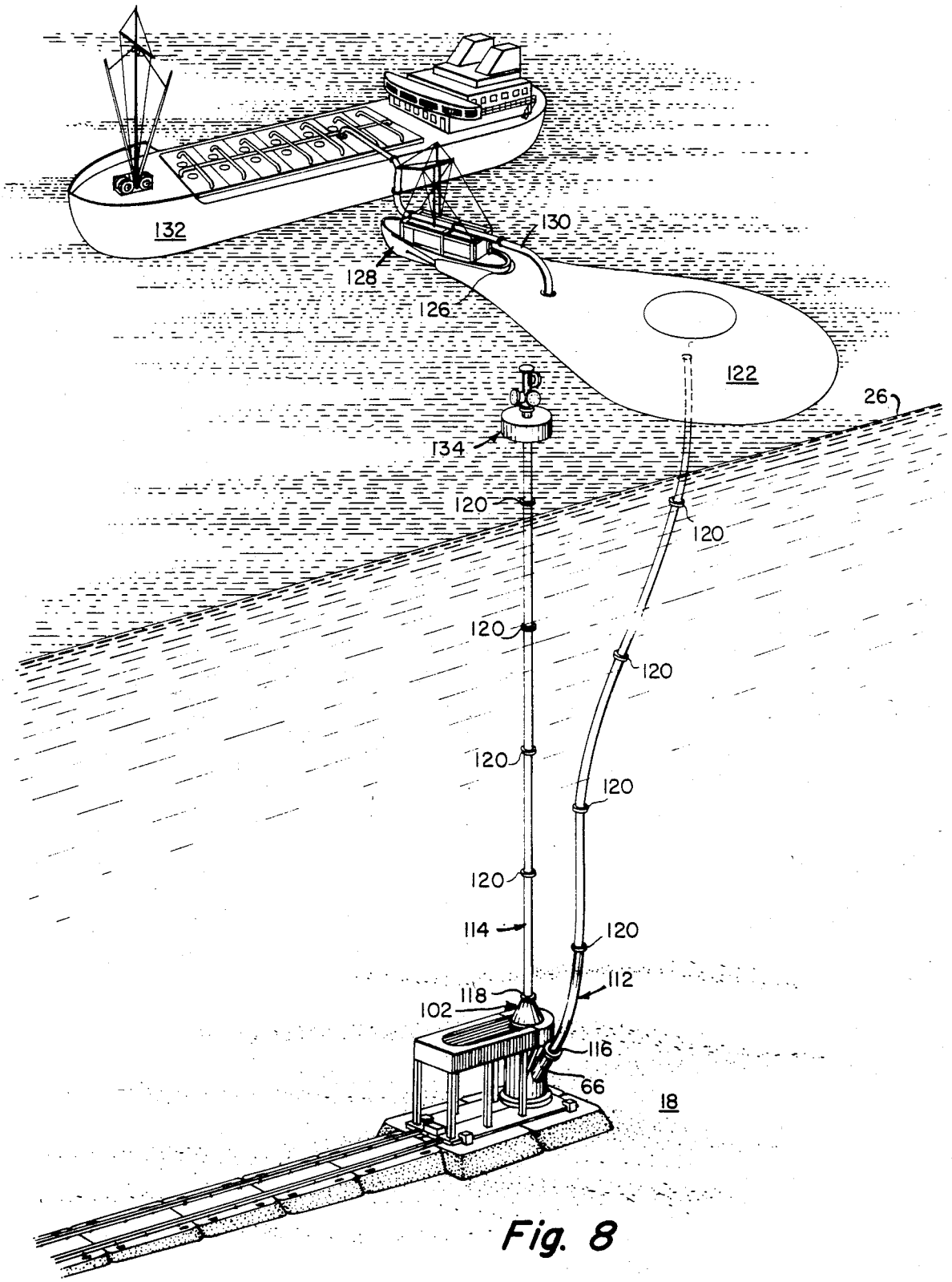
FIG. 8 is a view simular to FIG. 1 but showing the completed capping system in operation.

With the capping member 90 installed on the structure 80 and with the vertical channel 64, the oblique channel 66 and the outlet 68 all still in their open condition, the next step in the capping process involves, the withdrawal and removal of the device 60 from the scene and the attachment of a pair of flexible hoses 112 and 114 (note FIG. 8) respectively to the free end of the pipe 66 forming the oblique channel as well as to the top of the valve 102. The hoses 112 and 114 are secured to the pipe 66 and the valve 102 by means of swivels 116 and 118 to allow for their twisting with the underwater currents. In addition, the hoses 112 and 114 preferably are made of segments, with each segment connected to its adjacent segment by additional swivels 120. These additional swivels 120 serve to prevent entanglement of the hoses, with the consequent danger of their rupture. The hoses 112 and 114 are designed to withstand pressures of at least about 20,000 p.s.i.

At the surface 26, the hose 112 is connected to a floating bag 122 and the hose 114 to an appropriate floating oil or gas terminal 124. Preferably, the floating bag 122 is of teardrop shape, with a docking area 126 to accomodate the docking of a suitable pumping vessel 128. The pumping vessel 128 facilitates the transfer of oil or gas from within the bag 122 via a flexible hose 130 to an oceangoing tanker 132. Of course, in lieu of the illustrated single floating bag 122, a number of floating bags can be provided. If so, the hose 112 is appropriatly branched off so as also to connect to the additional floating bags. In the alternative, the pumping vessel 128 also can be used to pump oil or gas from the bag 122 to another bag, if temporarily no tanker 132 is available.

It will be recalled that with the hoses 112 and 114 attached to the pipe 66 and the valve 102, respectively, the blown oil or gas well head 12 has not as yet been capped since both the vertical channel 64 and the temporary outlet 68 are still in an open condition, permitting thus the unhindered escape of oil and/or gas from the broken well head 12. With the attachment of the hoses 112 and 114, first the temporary outlet 68 is closed off by lowering the sliding door 70 on its tracks 72 by actuating the means 74. Thereupon, the means 110 is actuated to slide the lid 100 into place above the collar member 50 so as to close off the vertical channel 64 thereof. Once this is accomplished, the only route open for the oil and/or gas escaping under pressure from the broken well head 12 is via the oblique channel represented by the pipe 66. Consequently, with the lid 100 in place, oil and/or gas will commence moving upward through the hose 112 and into the floating bag 122. This arrangement may then continue until such time that the hose 114 also is connected to a new surface terminal 134, ready to service the tanker 132 directly. Of course, the moving means 110 again has to be actuated first to slidably move the frusto-conical valve 102 into place above the collar member 50 and directly above the vertical channel 64 thereof, and second to slidably remove the lid 100 from above the vertical channel 64. Thereupon oil and/or gas from the broken well head 12 also can now escape upward though the vertical channel 64 and the valve 102 into the hose 114. Oil and/or gas from the well head 12 will continue exiting through the oblique channel formed by the pipe 66 and into the hose 112 until the channel is effectively closed off by actuating a valve 136 provided in the pipe 66, observe FIG. 5. This valve 136 preferably should not be shut before the new terminal 134 either is sufficiently strong to withstand the resultant pressure reaching it via the hose 114 or the terminal 134 is being tapped for continuous production via tankers or a pipeline leading to shore.

Thus it has been shown and described a method and a system 10 designed for controlling and/or capping undersea oil or gas well blowouts, which method and system 10 satisfy the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A system for controlling undersea oil or gas well blowouts comprising:

(a) an undersea oil or gas well head;

(b) a mound prepared about said well head;

(c) a road bed prepared on the sea bottom and leading to said mound, said road bed including a track and built to accommodate a device designed to do work about said well head;

(d) a base plate secured onto said mound about said well head, said base plate being longitudinally split prior to its being secured about said well head;

(e) an anchoring track formed integral with an on said base plate and surrounding said well head;

(f) said device being remotely controlled.

2. The system of claim 1 wherein said base plate is secured to said mound by a plurality of anchors fastened to sea rock underneath said sea bottom, and wherein said mound and said road bed are formed of a plurality of pre-formed segments on shore and carried to and assembled in situ about said well head.

3. The system of claim 2 wherein said road bed includes a pair of tracks.

4. A system for capping undersea oil or gas well blowouts comprising.

(a) an undersea oil or gas well head:

(b) a mound and a road bed prepared about said well head, said road bed designed to accomodate a device adapted to do work about said well head;

(c) a base plate, having an anchoring track and being axially split, secured onto said mound and about said well head;

(d) a hingeable collar member secured, via said anchoring track, to said base plate and about said well head, said collar member being formed with a vertical channel and an oblique channel;

(e) a bag floating on the sea surface above said well head; and (f) a hose connecting said oblique part to said floating bag.

5. The system of claim 4 further including a structure erected on said base plate adjacent said well head, said structure comprising a plurality of uprights, a pair of tracks secured to said uprights, and a capping member secured onto said pair of tracks.

6. The system of claim 5 wherein said capping member comprises a U-shaped housing open at one end, a pair of jaws hingelike secured to said housing at said open end, a plurality of spaced parallel channels formed internally in said housing, a lid slidable in one of said channels, a frusto-conical valve slidable in another one of said channels, and means for sliding said lid and said valve in their said respective channels.

7. The system of claim 6 wherein said means for sliding said lid and said valve is remotely operable.

8. The system of claim 7 wherein said bag floating on the sea surface is provided with means for removing oil or gas from the interior of said bag.

9. The system of claim 8 when said hose is provided with a plurality of swivels at periodic intervals between said well head and said floating bag, said hose built to withstand pressures of at least about 20,000 p.s.i.

10. A process of capping and/or controlling undersea oil/gas well blowouts comprising:

(a) preparing a mound about an undersea well head and a road leading up to said mound;

(b) anchoring a base plate onto said mound and about said well head;

(c) securing a collar member about said well head to said base plate, said member formed with a vertical channel and an oblique channel;

(d) providing at least one bag floating on the sea surface above said well head; and (e) connecting a flexible hose between said oblique channel of said collar member and said floating bag;

(f) at least some of said steps being effected with the aid of a device designed to be remotely operated and/or controlled.

11. A process of capping and/or controlling undersea oil/gas well blowouts comprising:

(a) preparing a mound about an undersea well head and a road leading up to said mound;

(b) anchoring a base plate onto said mound and about said well head;

(c) securing a collar member about said well head to said base plate, said member formed with a vertical channel and an oblique channel;

(d) providing at least one bag floating on the sea surface above well head; and (e) connecting a flexible hose between said oblique channel of said collar member and said floating bag;

(f) said preparing said mound and said road including preforming of segments comprising said mound and said road on shore, transporting said preformed segments to a site above said well head, preparing the sea bottom about said well head by the removal of debris, assembling in situ said preformed segments on the sea bottom about said well head and securing said segments onto said sea bottom in their assembled condition.

12. The process of claim 10 further including erecting a structure adjacent said collar member, securing a capping member onto said structure, and capping said well head with an operative part of said capping member by securing said part to said vertical channel of said collar member.

13. The process of claim 12 wherein said capping includes providing a temporary opening in said vertical channel of said collar member at a position diagonally across from said oblique channel before connecting said flexible hose to said oblique channel, and wherein said capping further includes covering first said vertical channel of said collar member with a lid, followed by sliding said operative part into position above said lid, and withdrawing said lid from above said vertical channel.

14. The process of claim 13 further including securing a second flexible hose to said operative part of said capping member.

* * * * *